US005441198A

United States Patent [19]

McQueeny

[11] Patent Number: 5,441,198

[45] Date of Patent: Aug. 15, 1995

[54] RECLOSABLE PRODUCT PACKAGING

[75] Inventor: Thomas P. McQueeny, Chicago, Ill.

[73] Assignee: R. R. Donnelley & Sons Company, Lisle, Ill.

[21] Appl. No.: 280,717

[22] Filed: Jul. 26, 1994

[51] Int. Cl.[6] ..... B65D 5/54; B65D 5/43

[52] U.S. Cl. ..... 229/102; 206/806; 229/125.37; 229/149; 229/162; 229/223

[58] Field of Search ..... 229/102, 125.37, 149, 229/162, 223; 206/806

[56] References Cited

U.S. PATENT DOCUMENTS

| | | | |
|---|---|---|---|
| 1,223,013 | 4/1917 | Wilson | 229/102 |
| 1,470,141 | 10/1923 | Bryson | 229/102 |
| 1,681,700 | 8/1928 | Folmer | 229/102 |
| 2,354,543 | 7/1944 | Ratcliff . | |
| 2,923,455 | 2/1960 | Tingley | 229/102 |
| 3,037,684 | 6/1962 | Andrews et al. . | |
| 3,288,349 | 11/1966 | Palmer et al. | 229/149 |
| 3,638,853 | 2/1972 | Perry . | |
| 3,814,303 | 6/1974 | Smith . | |
| 4,174,041 | 11/1979 | Turner . | |
| 4,230,259 | 10/1980 | Herzog | 229/149 |
| 4,266,671 | 5/1981 | Roccaforte . | |
| 4,279,376 | 7/1981 | Roccaforte . | |
| 4,291,807 | 9/1981 | Giordano et al. . | |
| 4,412,619 | 11/1983 | Van Laer . | |
| 4,438,846 | 3/1984 | Stylianou . | |
| 4,573,634 | 3/1986 | Kohler et al. . | |
| 4,712,689 | 12/1987 | Froom . | |
| 4,771,936 | 9/1988 | Dolby | 229/125.37 |
| 4,830,270 | 5/1989 | Holmes | 229/102 |
| 4,917,288 | 4/1990 | Heitele et al. | 229/102 |
| 4,949,845 | 8/1990 | Dixon | 206/806 |
| 5,190,200 | 3/1993 | Hammerlund | 229/149 |

FOREIGN PATENT DOCUMENTS

| | | | |
|---|---|---|---|
| 2251600 | 7/1992 | United Kingdom | 229/102 |

*Primary Examiner*—Gary E. Elkins

*Attorney, Agent, or Firm*—Marshall, O'Toole, Gerstein, Murray & Borun

[57] ABSTRACT

In order to be able to reclose a package for a product, the package includes a plurality of walls which in fully assembled relation include at least one package access wall and at least one package container wall. The package container wall is disposed at an angle to the package access wall, the latter of which has a tongue adapted to extend from inside to out through a slot in the package container wall so as to be in confronting relation to an outer surface thereof. With this arrangement, the tongue on the package access wall may be releasably secured to the outer surface of the package container wall in such manner as to releasably maintain the package access wall in a closed position.

20 Claims, 3 Drawing Sheets

RECLOSABLE PRODUCT PACKAGING

FIELD OF THE INVENTION

The present invention generally is related to reclosable product packaging and, more particularly, a reclosable product package of a type that may have an inherent tamper-evident feature.

BACKGROUND OF THE INVENTION

For a wide variety of products, it is well known to both ship and sell the product in some form of carton or container. The carton or container must, of course, be able to hold and protect the product from the time it is first placed in the carton or container until it reaches the consumer. As a result, the canon or container must be suited for product shipment as well as display for consumer selection at the retail outlet.

For this purpose, the canon or container must ideally be capable of meeting a number of different requirements. It must obviously house the product during shipment in a safe and economical fashion, but it must also be capable of presenting the product to the consumer in a manner enhancing the possibility that it will be selected at the retail outlet. Still additionally, the canon or container is oftentimes required to provide for a reasonable degree of protection against tampering.

At a minimum, it is usually desirable to be able to provide an indication of tampering that is evident from container or canon inspection. It is also often desirable for the canon or container to be capable of display in more than one manner, e.g., display by placement on a shelf or by hanging from a protruding rod or the like. Furthermore, it is frequently desirable to be able to reclose the container or canon for product storage by the consumer after purchase.

The present invention is directed to overcoming one or more of the foregoing problems and achieving one or more of the resulting objects.

SUMMARY OF THE INVENTION

It is therefore a principal object of the present invention to provide an improved reclosable product package. It is a further object of the present invention to provide a package which takes the form of a carton or container capable of enhancing presentation of the product in a retail outlet. It is an additional object of the present invention to provide an improved package that has a unique tamper-evident feature.

Accordingly, the present invention is directed to a package having a plurality of walls which in fully assembled relation include at least one package access wall and at least one package container wall. The package container wall is disposed at an angle to the package access wall which has a tongue adapted to extend from inside to out through a slot in the package container wall to be in confronting relation to an outer surface thereof. With this arrangement, the package also includes means for releasably securing the tongue to the outer surface of the package container wall to releasably maintain the package access wall in a closed position.

In an exemplary embodiment, the package access wall preferably comprises a top wall, and the package container wall preferably comprises a back wall. The plurality of walls advantageously further includes a front wall, a pair of side walls, and a bottom wall as additional ones of the package container walls, all of which define a rectangular container wherein the package access wall is perpendicular to the package container wall. Also, the top wall preferably has a tuck flap in confronting relation to an inner surface of the back wall in which case the tongue extends from the tuck flap. In one preferred embodiment, the releasable securing means preferably comprises first and second tongue portions adjacent and remote from the package access wall. The first portion then advantageously includes a tear strip with the second portion being adhesively secured to the outer surface of the back wall. In this preferred embodiment, the back wall may also be formed so as to extend beyond the top wall and to have an opening to define an integral hang card therefor.

In a highly preferred embodiment, it will be understood that the generally rectangular container is such that the top wall is normally disposed perpendicular to the back wall. The tongue then extends from the tuck flap through a slot in the back wall which is advantageously positioned below the top wall, and the tongue and slot preferably have a width which is substantially less than the width of the tuck flap and back wall. Still additionally, in the highly preferred embodiment, the removable tear strip of the first tongue portion is preferably defined by a pair of spaced, parallel perforations.

In this regard, the perforations are advantageously positioned nearer the top wall than the adhesively secured second tongue portion. It is also a feature of the invention to have a grip tab at one end of the first tongue portion to facilitate gripping and tearing the removable or severable tear strip from the package. For this purpose, the grip tab is advantageously defined by a V-shaped cut-out leading to each of the perforations defining the removable tear strip.

As previously mentioned, the slot in the back wall is preferably positioned below the top wall, and the tongue and slot each have a width substantially less than the width of the tuck flap and back wall. Still more specifically, the tongue and the slot are advantageously positioned centrally relative to the side walls and have a width on the order of one-half the width of the tuck flap and back wall.

In another respect, the package is such that the bottom wall includes a tuck flap and further includes means for locking the bottom wall in a closed position to secure a product within the container. The locking means advantageously includes a locking tab. For this purpose, the locking tab is preferably provided on the back wall at the end opposite the hang card, and a slot is provided between the bottom wall and tuck flap to receive the locking tab therein.

Other objects, advantages and features of the present invention will become apparent from a consideration of the following specification taken in conjunction with the accompanying drawings.

DETAILED DESCRIPTION OF THE PREFERRED EMBODIMENTS

Figure 1:
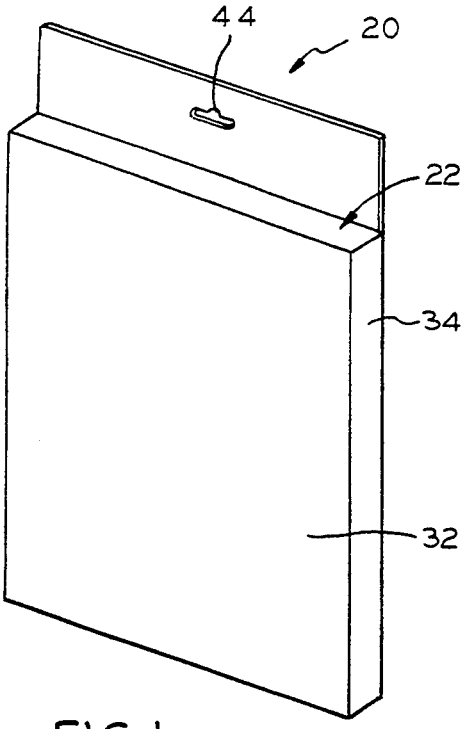
FIG. 1 is a front perspective view of a package incorporating the features of the present invention.
Figure 2:
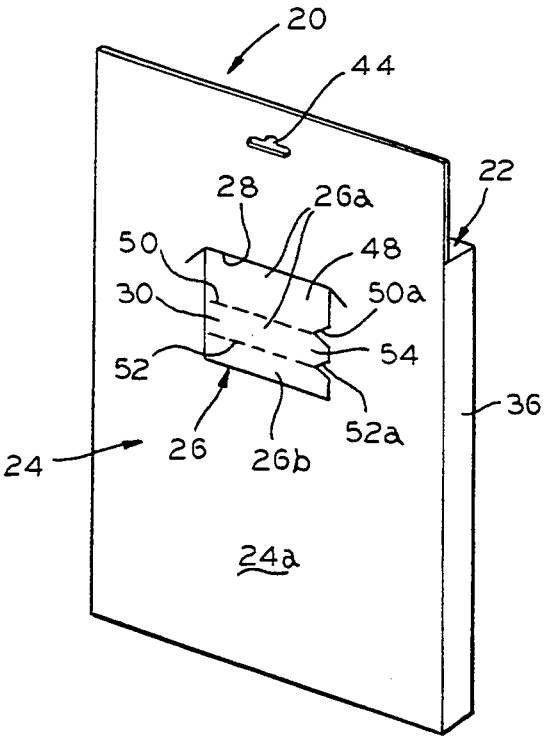
FIG. 2 is a rear perspective view of the package as illustrated in FIG. 1.
Figure 3:
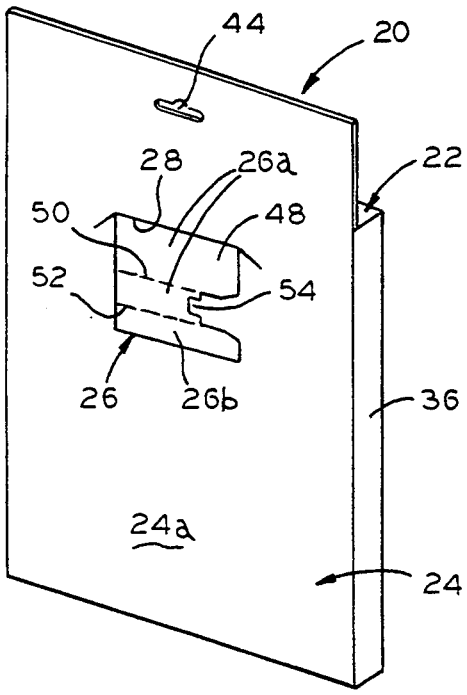
FIG. 3 is a rear perspective view similar to FIG. 2 showing removal of a tear strip.
Figure 4:
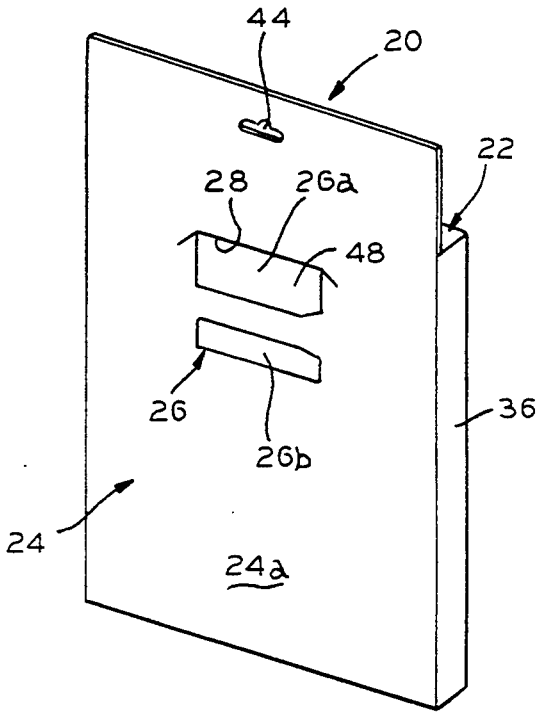
FIG. 4 is a rear perspective view similar to FIG. 3 following removal of the tear strip.

In the illustrations given, and with reference first to FIG. 1, the reference numeral 20 designates generally a package which incorporates features that are in accordance with the present invention. The package 20 comprises a carton or container that includes a plurality of walls which, in fully assembled relation, will be understood to include at least one package access wall 22 and at least one package container wall 24 at an angle thereto (see, also, FIG. 2). With this arrangement, the package access wall 22 has a tongue generally designated 26 which may extend from inside to out through a slot 28 in the package container wall 24 to be in confronting relation to an outer surface 24*a* thereof.

Referring to FIGS. 2–5, the package 20 will also be understood to include means for releasably securing the tongue 26 to the outer surface 24*a* of the package container wall 24 to releasably maintain the package access wall 22 in a closed position. The releasable securing means in this illustrated embodiment comprises first and second tongue portions 26*a* and 26*b* adjacent and remote from the package access wall 22, respectively. As will be appreciated from FIG. 3, the first tongue portion 26*a* preferably includes a tear strip 30, and the second tongue portion 26*b* is adhesively secured to the outer surface 24*a* of the package container wall 24.

In the embodiment illustrated in FIGS. 1–7, the package 20 will be seen and understood to comprise what may be called a tamper-evident hang card package. It will be appreciated that the package access wall 22 then comprises a top wall, and the package container wall 24 comprises a back wall. In addition, the plurality of walls may include a front wall 32, a pair of side walls 34 and 36, and a bottom wall 38 as additional ones of the package container walls.

Figure 5:
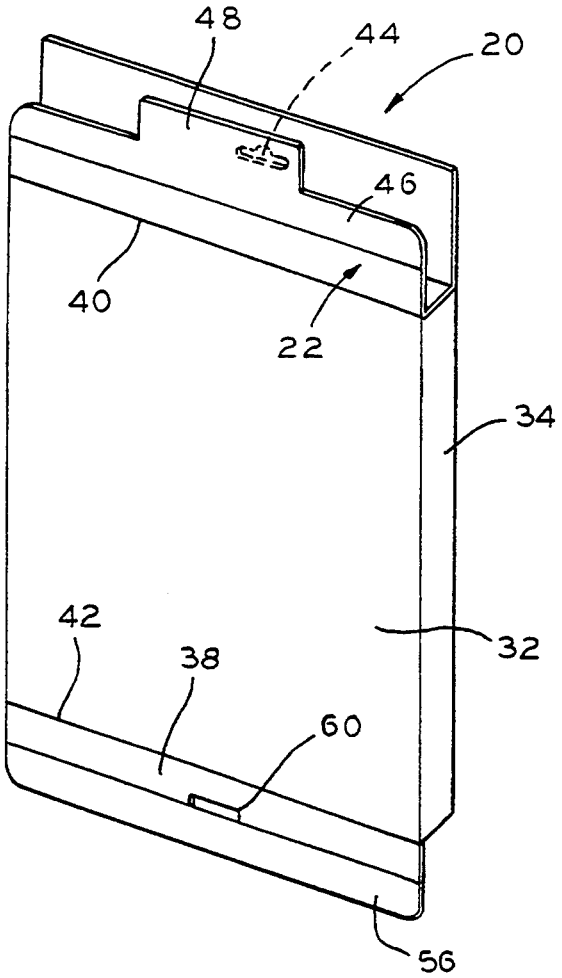
FIG. 5 is a front perspective view similar to FIG. 1 showing fully opened top and bottom walls.

As best shown in FIG. 5, the top wall 22 is integrally associated with the front wall 32 in hinge-like fashion at the upper end 40 thereof. It will also be seen that the front wall 32 is integrally associated with the side walls 34 and 36 which are, likewise, integrally associated with the back wall 24 about the perimeter of the package 20. Still additionally, the bottom wall 38 is integrally associated with the front wall 32 in hinge-like fashion at the lower end 42 thereof.

In this embodiment, the back wall 24 extends to a point upwardly beyond the top wall 22 at least when the top wall 22 is in a closed position as shown in FIGS. 1–4. The back wall 24 will also be seen and understood to have an opening 44 whereby the upward extension of the back wall 24 and the opening 44 define an integral hang card for the package 20. Also, in this embodiment, the plurality of walls advantageously defines a generally rectangular container wherein the top wall 22 is perpendicular to the back wall 24.

Referring to FIG. 5, the top wall 22 has a tuck flap 46 which is adapted to be placed in confronting relation to an inner surface of the back wall 24 (not shown). It will also be appreciated that the tongue 26 preferably includes a permanent portion 48 integral with the tuck flap 46 which, with the tear strip 30, comprises the entire the first tongue portion 26*a*. With this arrangement, the tongue 26 including the permanent portion 48 extends through the slot 28 below the top wall 22 as will be appreciated by referring to FIG. 4.

In the illustrated embodiment of FIGS. 1–7, the tongue 26 and the slot 28 each are formed so as to have a width which is substantially less than the width of the tuck flap 46 and the back wall 24. It has also previously been mentioned that there are severable first and second tongue portions 26*a* and 26*b*, i.e., there is a removable tear strip 30, defined by a pair of spaced, parallel perforations 50 and 52 positioned nearer the top wall 22 than the adhesively secured second tongue portion 26*b*. As an additional feature, the package 20 may include a grip tab 54 at one end of the tear strip 30 defined by V-shaped cut-outs 50*a* and 52*a* leading to each of the perforations defining the tear strip 30.

In the preferred embodiment illustrated in FIGS. 1–7, the tongue 26 and the slot 28 preferably have a width on the order of one-half the width of the tuck flap 46 and the back wall 24. It will be appreciated that the tongue 26 is thereby able to function so as to securely maintain the package 20 in a closed condition in a tamper-evident manner whereby the top or package access wall 22 can be opened only by a deliberate act of removing the tear strip 30 from the package. Until the tear strip 30 has been removed from the package 20, the adhesively secured second tongue portion 26*b* provides a significant degree of security for the product in the package 20.

Figure 6:
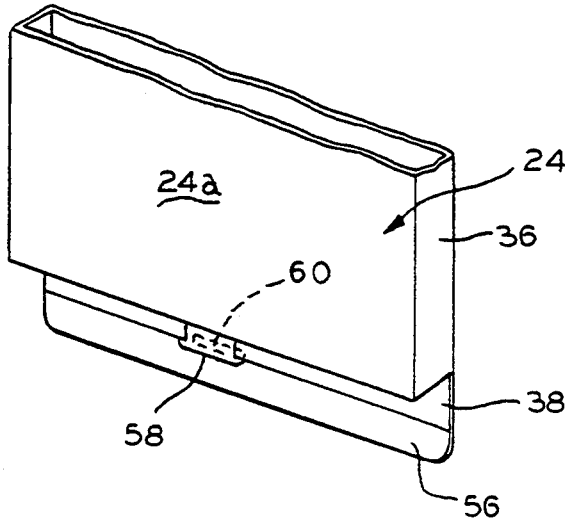
FIG. 6 is a partial rear perspective view similar to FIG. 2 showing a fully opened bottom wall.
Figure 7:
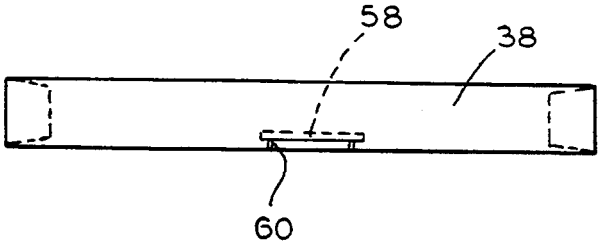
FIG. 7 is a bottom plan view of the package as illustrated in FIG. 1.

Referring now to FIG. 5–7, the bottom wall 38 will also have a tuck flap 56, together with means for locking the bottom wall 38 in a closed position to secure a product within the container or package 20. More specifically, the locking means includes a locking tab 58 on the back wall 24 at the end opposite the hang card and a slot 60 between the bottom wall 38 and tuck flap 56 to receive the locking tab 58 therein.

Figure 8:
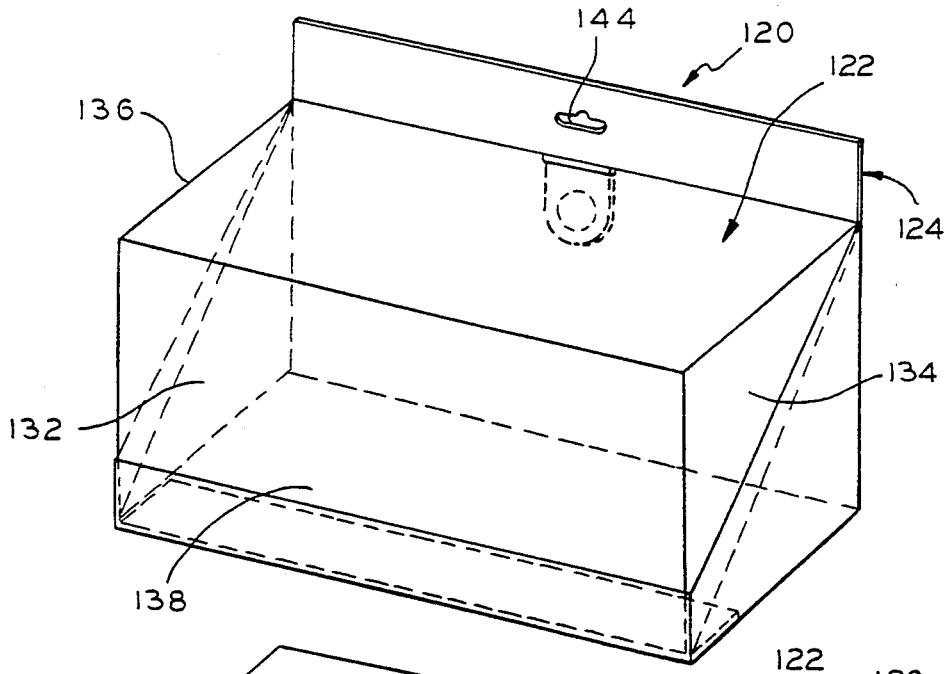
FIG. 8 is a front perspective view of another package embodiment in accordance with the present invention.
Figure 9:
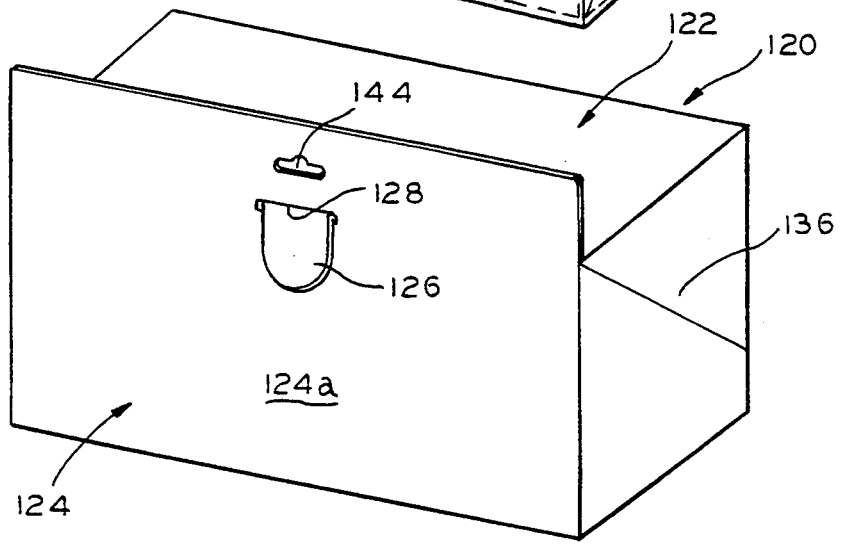
FIG. 9 is a rear perspective view of the package embodiment illustrated in FIG. 8.
Figure 10:
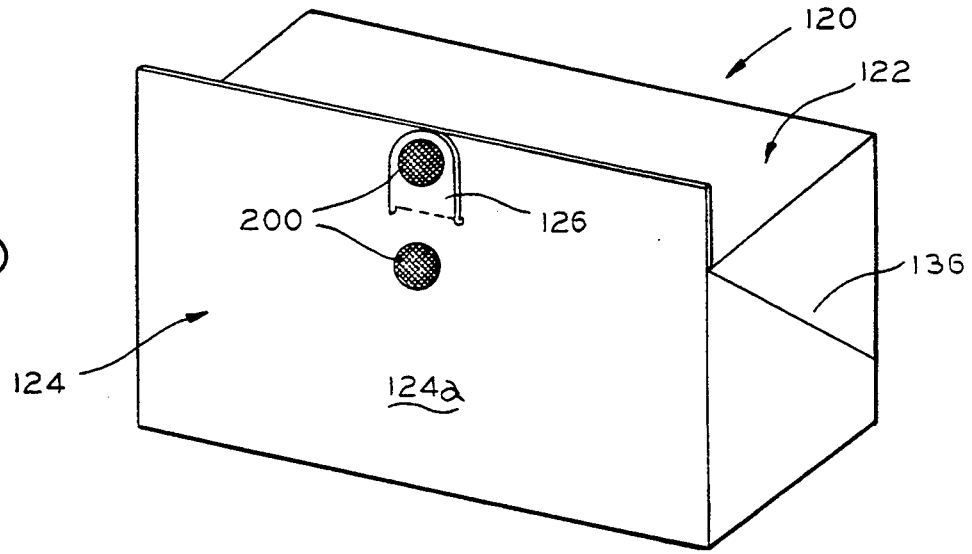
FIG. 10 is a rear perspective view similar to FIG. 9 showing release of the tongue for opening of the package.

Referring now to FIGS. 8–10, the reference numeral 120 designates generally another package embodiment which incorporates features that are in accordance with the present invention. The package 120 also includes a plurality of walls in fully assembled relation, including at least one package access wall 122 and at least one package container wall 124 at an angle thereto, and it is such that the package access wall 122 comprises a top wall, and the package container wall 124 comprises a back wall. With this arrangement, the plurality of walls further includes a front wall 132, a pair of side walls 134 and 136, and a bottom wall 138 as additional ones of the package container walls.

As will be appreciated, the plurality of walls define a generally rectangular container in which the top wall 122 is advantageously disposed generally perpendicular to the back wall 124. It will also be appreciated that the top wall 122 will have a tongue 126 extending from inside to out through a slot 128 in the back wall 124 to be in confronting relation to an outer surface 124*a*. Still additionally, the package 120 includes means for releasably securing the tongue 126 to the outer surface 124*a* of the back wall 124 to releasably maintain the top wall 122 in a closed position.

As illustrated in FIGS. 8–10, the back wall 124 may advantageously extend to a point upwardly beyond the top wall 122 and have an opening 144 to define an integral hang card therefore. The slot 128 will be seen to be positioned at or below the top wall 122, and the tongue 126 and slot 128 have a width substantially less than the width of the back wall 124. The front wall 132, side walls 134 and 136, and top wall 122 may also be such that at least a portion of each of them is formed of a transparent plastic material. Still additionally, the releasable securing means may advantageously include a hook and loop fastener system 200 on an inner surface of the tongue 126 and the outer surface of the back wall 124.

With the present invention, a unique new form of packaging has been provided that has several distinct advantages. It incorporates the use of a tongue integrally associated with a package access wall, e.g., the top wall, wherein the tongue is releasably secured to an outer surface of a package container wall, e.g., the back wall, out of normal vision of a consumer when the package is displayed in a retail outlet. In addition, the package can be formed so as to be of the hang card type and/or it may incorporate the unique tamper-evident feature.

While in the foregoing there have been set forth preferred embodiments of the invention, it will be appreciated that the details herein given may be varied by those skilled in the art without departing from the true spirit and scope of the appended claims.

I claim:

1. A package, comprising:

a plurality of walls in fully assembled relation including at least a package access wall and a package container wall at an angle to said package access wall;

said package access wall having a tongue adapted to extend from inside to out through a slot in said package container wall to be in confronting relation to an outer surface of said package container wall; and means for releasably securing said tongue to said outer surface of said package container wall to releasably maintain said package access wall in a closed position;

said releasable securing means comprising first and second tongue portions adjacent and remote from said package access wall, respectively, said first tongue portion including a tear strip and said second tongue portion being adhesively secured to said outer surface of said package container wall.

2. The package of claim 1 wherein said package access wall comprises a top wall and said package container wall comprises a back wall, said plurality of walls further including a front wall, a pair of side walls, and a bottom wall.

3. The package of claim 1 wherein said package access wall comprises a top wall and said package container wall comprises a back wall, said top wall having a tuck flap adapted to be placed in confronting relation to an inner surface of said back wall and said tongue extending from said tuck flap.

4. A package, comprising:

a plurality of walls in fully assembled relation including at least one package access wall and at least one package container wall at an angle to said package access wall, said package access wall comprising a top wall and said package container wall comprising a back wall, said plurality of walls further including a front wall, a pair of side walls, and a bottom wall;

said plurality of walls defining a generally rectangular container with said top wall perpendicular to said back wall and said top wall having a tuck flap adapted to be placed in confronting relation to an inner surface of said back wall and said tongue extending from said tuck flap to extend from inside to out through a slot in said back wall to be in confronting relation to an outer surface of said back wall; and means for releasably securing said tongue to said outer surface of said back wall to releasably maintain said top wall in a closed position:

said releasable securing means including severable first and second tongue portions adjacent and remote from said top wall, respectively, said first tongue portion including a tear strip and said second tongue portion being adhesively secured to said outer surface of said back wall.

5. A tamper-evident hang card package, comprising:

a plurality of walls in fully assembled relation including at least one package access wall and at least one package container wall at an angle to said package access wall, said package access wall comprising a top wall and said package container wall comprising a back wall, said plurality of walls further including a front wall, a pair of side walls, and a bottom wall;

said back wall extending to a point upwardly beyond said top wall and having an opening to define an integral hang card;

said plurality of walls defining a generally rectangular container with said top wall perpendicular to said back wall and said top wall having a tuck flat adapted to be placed in confronting relation to an inner surface of said back wall and said tongue extending from said tuck flap to extend from inside to out through a slot in said back wall to be in confronting relation to an outer surface of said back wall; and means for releasably securing said tongue to said outer surface of said back wall to releasably maintain said top wall in a closed position, said releasable securing means including severable first and second tongue portions adjacent and remote from said top wall, respectively.

6. The tamper-evident hang card package of claim 5 wherein said first tongue portion is a removable tear strip and said second tongue portion is permanently adhesively secured to said outer surface of said back wail.

7. The tamper-evident hang card package of claim 6 wherein said removable tear strip is defined by a pair of spaced, parallel perforations positioned nearer said top wall than said adhesively secured second tongue portion.

8. The tamper-evident hang card package of claim 7 including a grip tab at one end of said first tongue portion defined by a V-shaped cut-out leading to each of said perforations defining said removable tear strip.

9. The tamper-evident hang card package of claim 5 wherein said slot is positioned below said top wall and said tongue and slot each have a width substantially less than the width of said tuck flap and back wall.

10. A tamper-evident hang card package, comprising:

a plurality of walls in fully assembled relation including at least one package access wall and at least one package container wall at an angle to said package access wall, said package access wall comprising a top wall and said package container wall comprising a back wall, said plurality of walls further including a front wall, a pair of side walls, and a bottom wall;

said top wall being integrally associated with said front wall in hinge-like fashion at an upper end of said front wall, said front wall being integrally associated with said side walls which are integrally associated with said back wall about a perimeter of said package, and said bottom wall being integrally associated with said front wall in hinge-like fashion at a lower end of said front wall;

said back wall extending to a point upwardly beyond said top wall when said top wall is in a closed position and having an opening to define an integral hang card;

said plurality of walls defining a generally rectangular container with said top wall perpendicular to said back wall and said top wall having a tuck flap adapted to be placed in confronting relation to an inner surface of said back wall and said tongue extending from said tuck flap to extend from inside to out through a slot in said back wall to be in confronting relation to an outer surface of said back wall;

said slot being positioned below said top wall and said tongue and slot each have a width substantially less than the width of said tuck flap and back wall; and means for releasably securing said tongue to said outer surface of said back wall to releasably maintain said top wall in a closed position, said releasable securing means including severable first and second tongue portions adjacent and remote from said top wall, respectively, said first tongue portion being a removable tear strip and said second tongue portion being permanently secured to said outer surface of said back wall.

11. The tamper-evident hang card package of claim 10 wherein said removable tear strip is defined by a pair of spaced, parallel perforations positioned nearer said top wail than said adhesively secured second tongue portion.

12. The tamper-evident hang card package of claim 11 including a grip tab at one end of said first tongue portion defined by a V-shaped cut-out leading to each of said perforations defining said removable tear strip.

13. The tamper-evident hang card package of claim 10 wherein said tongue and said slot are centrally positioned relative to said side wails having a width of approximately one-half the width of said tuck flap and back wall.

14. The tamper-evident hang card package of claim 10 wherein said bottom wail includes a tuck flap and further including means for locking said bottom wail in a closed position to secure a product within said container.

15. The tamper-evident hang card package of claim 14 wherein said locking means includes a locking tab on said back wall at an end opposite said hang card and a slot between said bottom wall and tuck flap to receive said locking tab therein.

16. A package, comprising:

a plurality of walls in fully assembled relation including a package access wall and a package container wall at an angle to said package access wall;

said package access wall having a tongue adapted to extend from inside to out through a slot in said package container wall to be in confronting relation to an outer surface of said package container wall; and means for releasably securing said tongue to said outer surface of said package container wall to releasably maintain said package access wall in a closed position;

said plurality of walls defining a rectangular container with said package access wall perpendicular to said package container wall, said package container wall extending beyond said package access wall and having an opening to define an integral hang card.

17. The package of claim 16 wherein said package access wall comprises a top wall and said package container wall comprises a back wall, said plurality of walls further including a front wall, a pair of side walls, and a bottom wall.

18. The package of claim 16 wherein said package access wall comprises a top wall and said package container wall comprises a back wall, said top wall having a tuck flap adapted to be placed in confronting relation to an inner surface of said back wall and said tongue extending from said tuck flap.

19. The package of claim 17 wherein at least a portion of said front, side and top walls of said container are formed of a transparent plastic material, and wherein said releasable securing means includes a hook and loop fastener system on an inner surface of said tongue and an outer surface of said back wall.

20. A package, comprising:

a plurality of walls in fully assembled relation including at least one package access wall and at least one package container wall at an angle to said package access wall, said package access wall comprising a top wall and said package container wall comprising a back wall, said plurality of walls further including a front wall, a pair of side walls, and a bottom wall;

said plurality of walls defining a generally rectangular container with said top wall perpendicular to said back wall and said top wall having a tuck flap adapted to be placed in confronting relation to an inner surface of said back wall and said tongue extending from said tuck flap to extend from inside to out through a slot in said back wall to be in confronting relation to an outer surface of said back wall; and means for releasably securing said tongue to said outer surface of said back wall to releasably maintain said top wall in a closed position;

said back wall extending to a point upwardly beyond said top wall and having an opening to define an integral hang card, said slot positioned below said top wall and said tongue and slot having a width substantially less than the width of said tuck flap and back wall.

* * * * *